US006286467B1

(12) United States Patent
Ancheta

(10) Patent No.: US 6,286,467 B1
(45) Date of Patent: Sep. 11, 2001

(54) TWO STROKE ENGINE CONVERSION

(76) Inventor: Antonio Ancheta, 10942 - 143 Street, Surrey, BC (CA), V3R 3M3

( * ) Notice: Subject to any disclaimer, the term of this patent is extended or adjusted under 35 U.S.C. 154(b) by 0 days.

(21) Appl. No.: 09/472,196

(22) Filed: Dec. 27, 1999

(51) Int. Cl.[7] ..... F02B 69/06
(52) U.S. Cl. ..... 123/21
(58) Field of Search ..... 123/65 R, 65 BA, 123/559.1, 560, 90.6, 90.27, 90.16, 90.17, 90.18, 21, 636, 58.7, 59.7

(56) References Cited

U.S. PATENT DOCUMENTS

| | | | | |
|---|---|---|---|---|
| 4,018,050 | | 4/1977 | Murphy . | |
| 4,102,130 | | 7/1978 | Stricklin . | |
| 4,162,662 | * | 7/1979 | Melchior | 123/65 VD |
| 4,353,334 | * | 10/1982 | Neitz | 123/179.21 |
| 4,671,226 | * | 6/1987 | Rinsum | 123/179.31 |
| 5,005,539 | * | 4/1991 | Kawamura | 123/21 |
| 5,022,353 | * | 6/1991 | Kamamura | 123/21 |
| 5,036,801 | * | 8/1991 | Imajou | 123/21 |
| 5,113,805 | * | 5/1992 | Kawamura | 123/21 |
| 5,154,141 | | 10/1992 | McWhorter . | |
| 5,158,044 | * | 10/1992 | Kawamura | 123/21 |
| 5,193,492 | * | 3/1993 | Kawamura | 123/21 |
| 5,515,675 | | 5/1996 | Bindschatel . | |
| 5,517,951 | * | 5/1996 | Paul et al. | 123/21 |

* cited by examiner

*Primary Examiner*—Noah P. Kamen
*Assistant Examiner*—Hai Huynh
(74) *Attorney, Agent, or Firm*—Adrian D. Battison

(57) ABSTRACT

A method is provided for converting a conventional four stroke internal combustion engine having four cylinders into a two stroke engine. The camshaft assembly including the camshaft having cams thereon and the drive assembly which couples the camshaft to the crankshaft are replaced with a modified camshaft assembly such that the inlet and exhaust valves are each opened once per revolution of the camshaft. The resulting two stroke engine includes two pairs of pistons, each pair of pistons having a first and second piston which are fired synchronously. The pairs of pistons being spaced 180 degrees apart such that two pistons are fired synchronously for every half rotation of the crankshaft.

20 Claims, 6 Drawing Sheets

TWO STROKE ENGINE CONVERSION

FIELD OF THE INVENTION

This application relates to a method and apparatus for converting an internal combustion engine from four stroke operation to two stroke operation which is applicable to various sizes and configurations of engines having either spark or compression ignition.

BACKGROUND

Four stroke internal combustion engines having varying numbers of cylinders are commonly used in various types of vehicles as they are known to make relatively efficient use of fuel as opposed to a two stroke internal combustion engine. For certain applications however, it is desirable to make use of the improved torque characteristics associated with two stroke engines. Adapting a conventional four stroke engine however, into a conventional two stroke engine is generally a costly and time consuming procedure as adjustment of the relative orientation of the pistons as well as the location and timing of the valves comprises a substantial replacement of parts.

U.S. Pat. No. 5,154,141 to McWhorter describes an internal combustion engine which operates as a four stroke engine at low speeds and as a two stroke engine at higher speeds. The cycle frequency of the valve operation is doubled for two stroke operation by gearing the camshaft to rotate at crankshaft speed rather than at half crankshaft speed as in four stroke operation. In order to successfully convert from four stroke operation to two stroke operation the engine requires a complex arrangement of a gas ejector and an electronic timing circuit which controls the rate of fuel injection and spark ignition. The complex arrangement of numerous parts results in a costly and high maintenance engine design in order to make use of the benefits of two stroke operation.

SUMMARY

According to one aspect of the present invention there is provided a method of converting to two stroke operation a four stroke internal combustion engine having a plurality of pistons arranged for reciprocating movement within respective cylinders, an inlet valve and an exhaust valve associated with each cylinder, a crankshaft coupled to the pistons, the crankshaft being driven to rotate by reciprocation of the pistons, a original camshaft assembly coupled to the crankshaft, the camshaft assembly comprising at least one original camshaft carrying a plurality of original cams for actuating respective inlet and exhaust valves and an original drive assembly coupling the camshaft to the crankshaft such that the camshaft is rotated at half a speed of the crankshaft; said method comprising:

- providing a replacement camshaft assembly for actuating the respective inlet and exhaust valves, the replacement camshaft being arranged to open the valves once per revolution of the crankshaft; and
- replacing the original camshaft assembly with the replacement camshaft assembly.

A conventional four stroke, four cylinder engine is thus converted to a two stroke engine wherein two pistons are fired synchronously every half revolution of the crankshaft with a minimal replacement of parts. The resulting engine exhibits improved torque characteristics without expensive or time consuming engine refitting. The camshaft assembly can be replaced using conventional tooling without requiring extensive work to the engine.

The replacement camshaft assembly preferably comprises at least one replacement camshaft carrying a plurality of replacement cams, each replacement cam having a pair of lobes such that a corresponding one of the valves is opened twice per revolution of the camshaft. The pair of lobes of each replacement cam are preferably 180 degrees out of phase from each other. The replacement drive assembly thus comprises a driven sprocket on the replacement camshaft driven by a driving sprocket on the crankshaft, the driven sprocket having twice a number of teeth of the driving sprocket such that the replacement camshaft is rotated at half crankshaft speed.

Alternatively, the replacement camshaft assembly may comprise a replacement drive assembly having a driven sprocket on a replacement camshaft driven by a driving sprocket on the crankshaft, the driven sprocket having a number of teeth equal to a number of teeth on the driving sprocket such that the replacement camshaft is rotated at crankshaft speed. Each replacement cam thus preferably includes a single lobe such that a corresponding one of the valves is opened once per revolution of the camshaft.

The method may further include mounting a turbocharger, a supercharger or both on the engine in communication with the inlet valves.

When the engine includes electronic fuel injection, said method includes programming the electronic fuel injection to inject fuel in each cylinder once per revolution of the crankshaft.

Alternatively, when the engine includes a cam actuated fuel injector driven by the crankshaft, the method may include providing dual lobed fuel injector cams driven at half crankshaft speed for injecting fuel into the respective cylinders once per revolution of the crankshaft.

When the engine includes a cam actuated fuel injector driven by the crankshaft, said method may include providing a single lobed fuel injector cams driven at crankshaft speed for injecting fuel into the respective cylinders once per revolution of the crankshaft.

For an engine having a plurality of pairs of pistons, said method preferably includes firing each pair of pistons synchronously once per revolution of the crankshaft.

When using a supercharger or turbocharger, the method may include providing a pressure feed lubrication system within a sump of the engine.

According to a further aspect of the present invention there is provided a two stroke internal combustion engine comprising:

- a plurality of pairs of pistons arranged for sliding movement within respective cylinders, a first and second piston of each pair of pistons being located in a same position relative to the respective cylinders as the first and second pistons are displaced within the respective pistons such that the first and second pistons are fired synchronously;
- an inlet valve and an exhaust valve associated with each cylinder;
- a crankshaft coupled to the pistons, the crankshaft being driven to rotate by reciprocation of the pistons;
- a camshaft assembly coupled to the crankshaft, the camshaft assembly comprising:
  - a plurality of cams mounted on a camshaft for engaging respective inlet and exhaust valves; and
  - a drive assembly coupling the camshaft to the crankshaft such that the cams open the respective valves once per revolution of the crankshaft.

The operation of the pistons in a two stroke configuration makes use of the improved torque characteristics of two stroke engines. Firing the pistons synchronously in pairs further improves the torque characteristics of the engine for improved engine performance.

Each cam preferably includes a pair of lobes spaced 180 degrees apart about the camshaft and the drive assembly couples the camshaft to the crankshaft to rotate the camshaft at half crankshaft speed such that each of the valves is opened twice per revolution of the camshaft.

The engine preferably includes two pairs of pistons, the first and second pistons of each pair of pistons being arranged to fire synchronously once per revolution of the crankshaft. The pairs of pistons are preferably fired 180 degrees apart.

There may be provided air supply means mounted in communication with the inlet valves for supplying combustion air above atmospheric pressure to the cylinders.

There may be provided a cam actuated fuel injector for injecting fuel into the respective cylinders and dual lobed cams driven at half crankshaft speed for injecting fuel into the respective cylinders once per revolution of the crankshaft.

BRIEF DESCRIPTION OF THE DRAWINGS

In the accompanying drawings, which illustrate an exemplary embodiment of the present invention.

DETAILED DESCRIPTION

Figure 1:
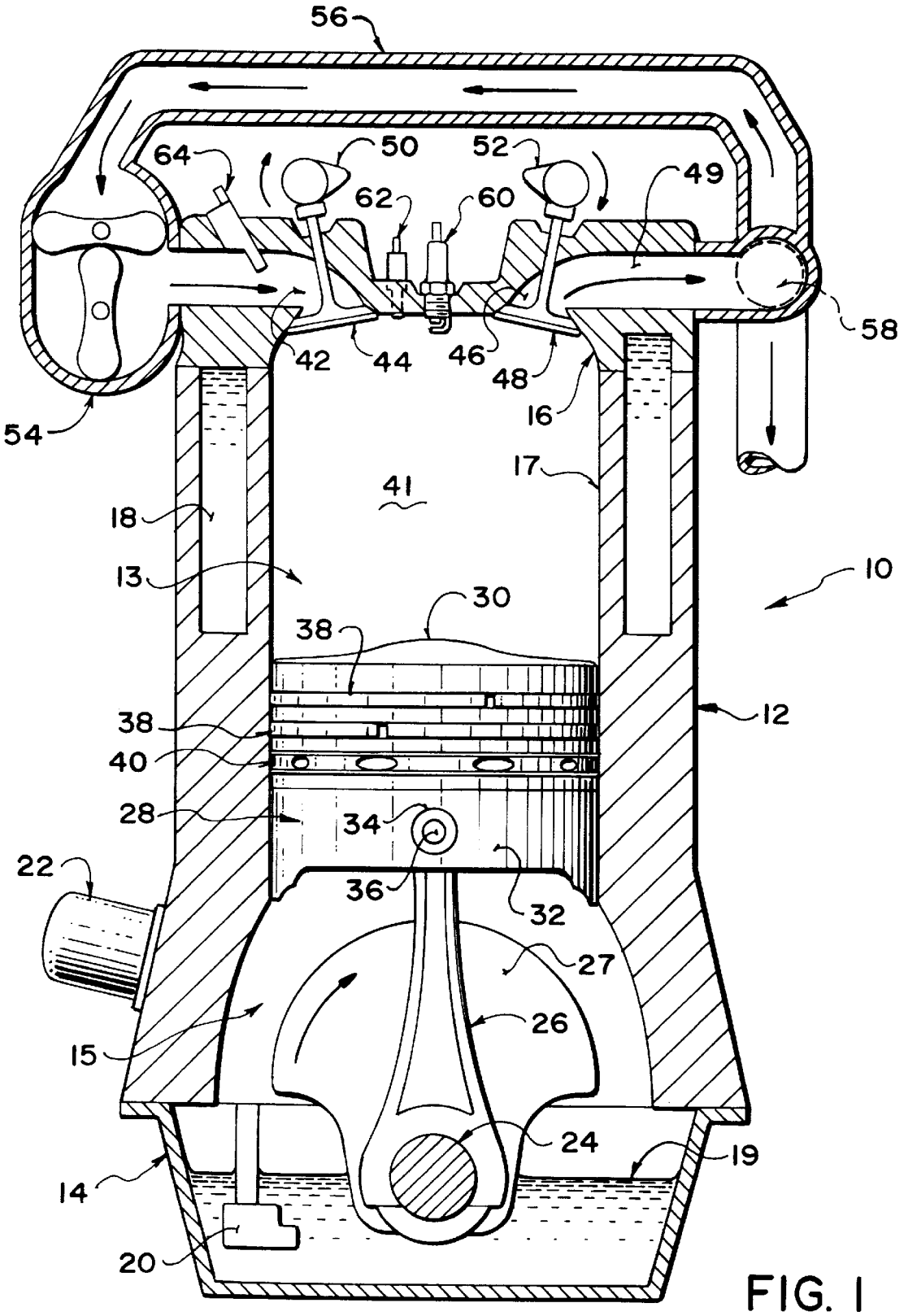
FIG. 1 is a cross sectional view of a piston cylinder arrangement within a spark ignition variant of the engine.

Referring to the accompanying drawings, there is illustrated an engine generally indicated by reference numeral 10. The engine 10 is a conventional inline four cylinder engine which has been modified from four stroke operation to two stroke operation such that two pistons fire simultaneously with each half rotation of the crankshaft.

The engine 10 includes an engine block 12 having four cylindrical bores 13 extending therethrough from a top end to a bottom end. The cylindrical bores are spaced one beside the other in a row. The block 12 includes an oil pan 14 which encloses the bottom end of the bores 13 and a cylinder head 16 which encloses the top end. Each bore forms a cylinder 17 which houses a piston assembly 15 therein.

A cooling jacket 18 extends through the block 12 and cylinder head 16 for passing cooling fluid therethrough such that the engine block is cooled in a conventional manner.

The oil pan 14 acts as a sump for collecting lubricating oil 19 which is drained from the engine. The oil 19 is drawn from the oil pan 14 by a regulated constant pressure, continuous feed oil pump 20 and fed by the pump through an oil filter 22 to a recirculating lubricating system of the engine.

A crankshaft 24 is mounted on the engine block 12 to extend across the bottom end of each cylinder 17. The crankshaft 24 is supported on bearings for rotation about a longitudinal axis 25. The bearings are mounted on the engine block in a conventional manner.

Each piston assembly 15 includes a connecting rod 26 which is pivotally mounted at a bottom end on the crankshaft, spaced radially from the longitudinal axis 25, diametrically opposed from a corresponding counterweight 27 mounted on the crankshaft. A top end of the connecting rod 26 is pivotally mounted on a piston 28 which is arranged for sliding movement within the corresponding cylinder 17.

Each piston 28 is a cylindrical member having a domed crown 30 on a top face and a short skirt 32 extending downward from a bottom end. Diametrically opposed bosses 34 in the skirt 32 pivotally support respective ends of a wrist pin therein. The wrist pin pivotally mounts the top end of the connecting rod 26 thereon for coupling the connecting rod to the piston 28. The wrist pin may be press fit into the connecting rod or of a full floating type. Retainers can be mounted on the bosses 34 as required for retaining the respective ends of the wrist pin therein.

A pair of annular compression ring seals 38 are mounted spaced apart about an outer face of the skirt 32 for sealing the piston against the side walls of the cylinder 17. An oil control ring 40 is formed below the ring seals 38 for controlling lubrication to the side walls of the cylinder 17 as the piston reciprocates within the cylinder.

A combustion chamber 41 is defined within the cylinder 17 between the piston crown 30 and the cylinder head 16. The oil control ring 40 restricts the lubricating oil from seeping into the combustion chamber 41 from the bottom end of the cylinder.

An inlet and scavenger port 42 is mounted in the cylinder head 16 for communicating with the combustion chamber and for supplying fresh air into the combustion chamber 41 when an inlet poppet valve 44 mounted within port 42 is opened. An exhaust port 46 is mounted in the cylinder head for communicating with the combustion chamber and for removing exhaust gases from the combustion chamber when an exhaust poppet valve 48 mounted within the port 46 is opened. The exhaust gases are subsequently expelled through an exhaust manifold 49.

Figure 2:
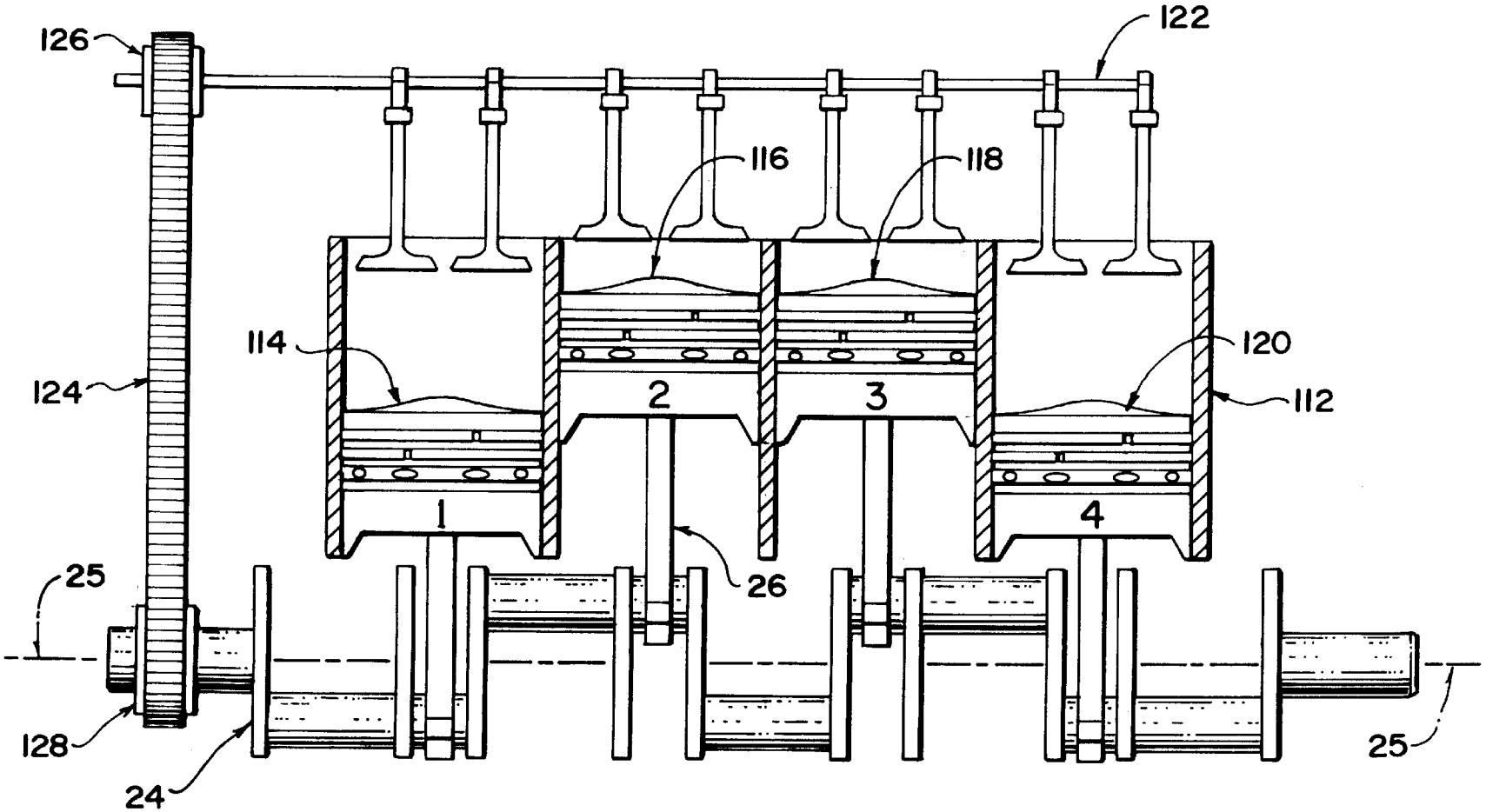
FIG. 2 is a longitudinal cross sectional view of the engine showing four inline cylinders arranged for two stroke operation.

The inlet poppet valve 44 is controlled by an inlet valve cam 50 having a steep cam profile providing the required short opening duration. The exhaust poppet valve 48 is similarly controlled by an exhaust valve cam 52 which also has a steep cam profile. The inlet and exhaust valves are illustrated laterally spaced apart in FIG. 1, however their operation is similar when the valves of all the cylinders are mounted along a common longitudinal axis as shown in FIG. 2.

Scavenging air above atmospheric pressure is pumped into the combustion chamber 41 through the inlet port 42 by a supercharger 54. The supercharger 54 is a conventional type which delivers a controlled amount of pressurised air with each pumping cycle. The supercharger 54 further pressurises air which is already pressurised which the supercharger receives from a duct 56 15 connected to a turbocharger 58. The turbocharger 58 is coupled to the exhaust port and is driven by the exhaust gases exiting the cylinder 17.

The use of a supercharger allows the pump for the lubricating oil to provide lubrication under pressure to the components of the engine because the sump is not used to pump air through the inlet valves in this arrangement.

A spark ignition system is mounted in the cylinder head 16 and includes a spark plug 60 mounted at the top end of each cylinder 17. A fuel injector 62 is mounted in the cylinder head 16 adjacent to each spark plug 60. The fuel injector 62 is an electronically controlled direct injection type. Alternatively to fuel injector 62, a computerised electronically controlled multi-point, multi-port fuel injector 64 can be mounted upstream within the inlet port 42 for injecting fuel directly into the inlet manifold. In either case, the injector 62 or 64 is a known programmable type injector having an adjustable quantity of fuel delivered and an adjustable timing for varying engine speed and power output.

In operation, pressurised air is admitted into the cylinder and creates a turbulent swirling motion to scavenge the burnt combustion gases, to drive them from the exhaust port 46. This provides a relatively clean combustion with a low level of exhaust gas emissions to the atmosphere.

The supercharger 54 is equipped with an air cleaner which is not illustrated. The supercharger is operatively connected to the crankshaft by either a V-belt and pulleys or a timing chain and sprockets in a conventional manner. The oil pump 20 is similarly connected to the crankshaft. The turbocharger 58 also has an air cleaner which is not illustrated, the air cleaner being bolted to the exhaust manifold 49 The supercharger and turbocharger can be connected in parallel or in series while still operating effectively.

FIG. 2 shows the four inline cylinders 17 arranged for two stroke operation. A first piston 114 and a fourth piston 120 on opposing ends of the block are shown in a bottom dead centre position. In the bottom dead centre position both the inlet and scavenger valve 44 and the exhaust valve 48 are in a fully open position. A second piston 116 and a third piston 118 which are spaced between the first and fourth pistons, are both shown in a top dead centre position. In the top dead centre position both the inlet and scavenger valve 44 and the exhaust valves 48 are in a fully closed position. The first and fourth pistons 114, 120 are thus shown 180 degrees out of phase of the second and third pistons 116, 118.

In this arrangement, the first and fourth pistons are fired simultaneously while the second and third pistons fire simultaneously 180 degrees out of phase from the first and fourth pistons such that two pistons are fired simultaneously for each half rotation of the crankshaft in a four cylinder engine.

A camshaft 122 is mounted in the cylinder head for opening and closing the inlet and scavenger valves 44 and the exhaust valves 48. The camshaft includes the inlet valve cams 50 and the exhaust valve cams 52. The cams 50 and 52 of the first and fourth pistons 114 and 120 are oriented in the same respective radial directions relative to the camshaft while the cams 50 and 52 of the second and third pistons 116 and 118 are also oriented in the same respective radial directions relative to the camshaft.

The camshaft 122 is coupled to rotate with the crankshaft 24 by a timing chain 124, a driven sprocket 126 and a driving sprocket 128 mounted on the camshaft and crankshaft respectively. The sprockets 126 and 128 have equal dimensions and an equal number of teeth such that the camshaft and the crankshaft rotate at the same speed. The cams 50 and 52 are thus arranged to open the respective valve once for each revolution of the camshaft.

Figure 3:
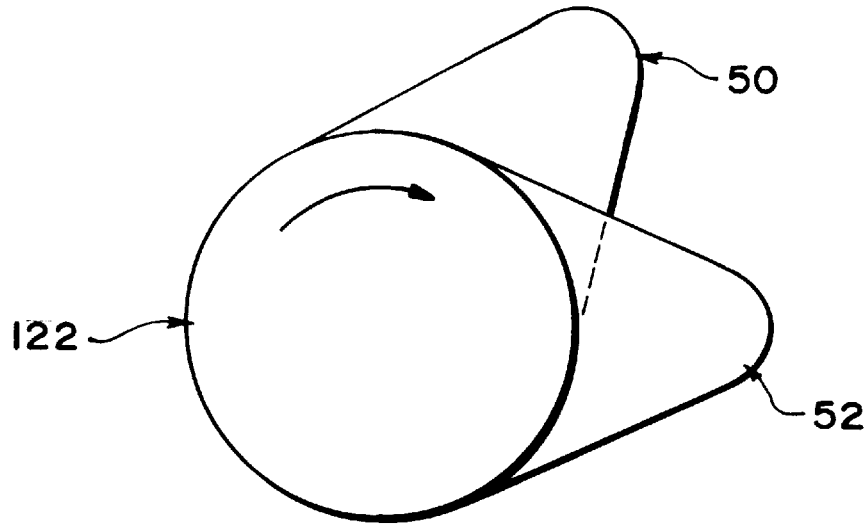
FIG. 3 is an end view of a camshaft having single lobed cams thereon.

An end view of the camshaft 122 is illustrated in FIG. 3 which shows the relationship between the inlet and exhaust valve cams 50 and 52 for one cylinder. The exhaust valve opens before the inlet valve opens and closes before the inlet valve closes. The inlet and exhaust valve cams are shown to overlap for a portion of the rotation at bottom dead centre when both valves are open.

Figure 4:
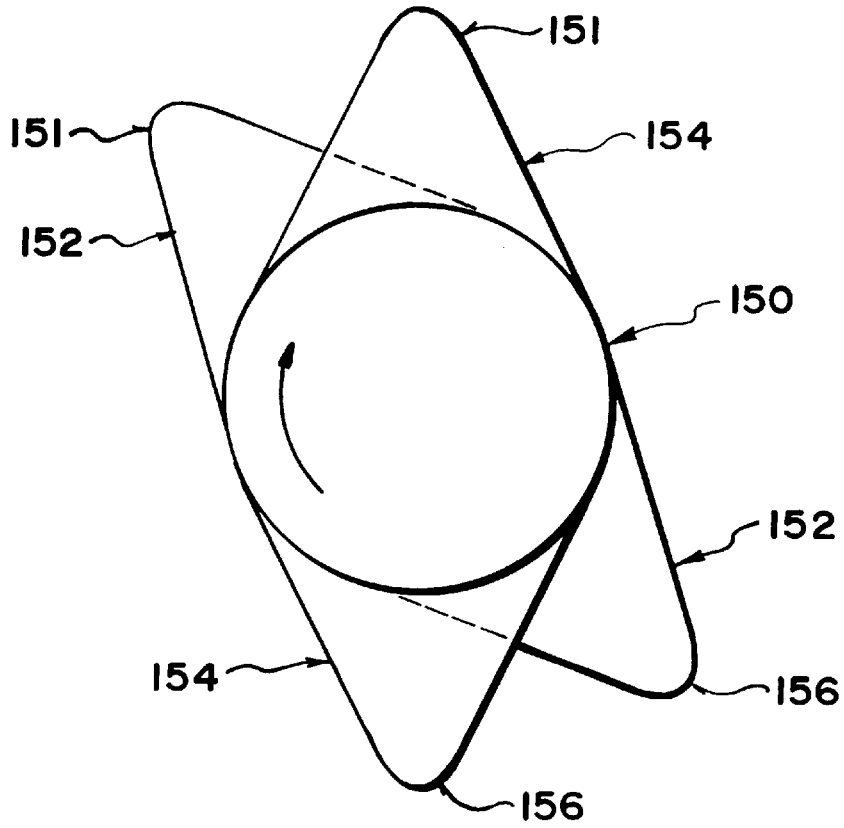
FIG. 4 is an end view of a camshaft having dual lobed cams thereon.

In a further embodiment of FIG. 4, a camshaft 150 is shown in an end view with cams for operating a single cylinder thereon. The camshaft 150 includes dual lobed cams. A first lobe 151 of each of the inlet valve cam 152 and the exhaust valve cam 154 are oriented relative to each other to extend radially in the same direction as the cams of the camshaft 122, however a second lobe 156 is located diametrically opposite from each first lobe 151. In this arrangement the second lobes are 180 degrees out of phase from the first lobes such that the camshaft is only required to turn at half the crankshaft speed to effectively open and close the valve once for each revolution of the crankshaft. The camshaft 150 has a driven sprocket mounted thereon having twice as many teeth as the driving sprocket 128 for rotation at half crankshaft speed in use.

The camshaft 122 is particularly useful for converting a four stroke engine into a two stroke engine with a minimal replacement of parts as the gearing for the camshaft does not need readjusting. In a four stroke engine, the camshaft operating the valves is generally geared to rotate at half crankshaft speed such that each valve is opened once for every two rotations of the crankshaft. In converting a four stroke to a two stroke engine, the gearing between the camshaft and crankshaft can be preserved by replacing the camshaft to one having dual lobed cams such that the valves are opened once for each revolution of the crankshaft as desired for two stroke operation.

Figure 5:
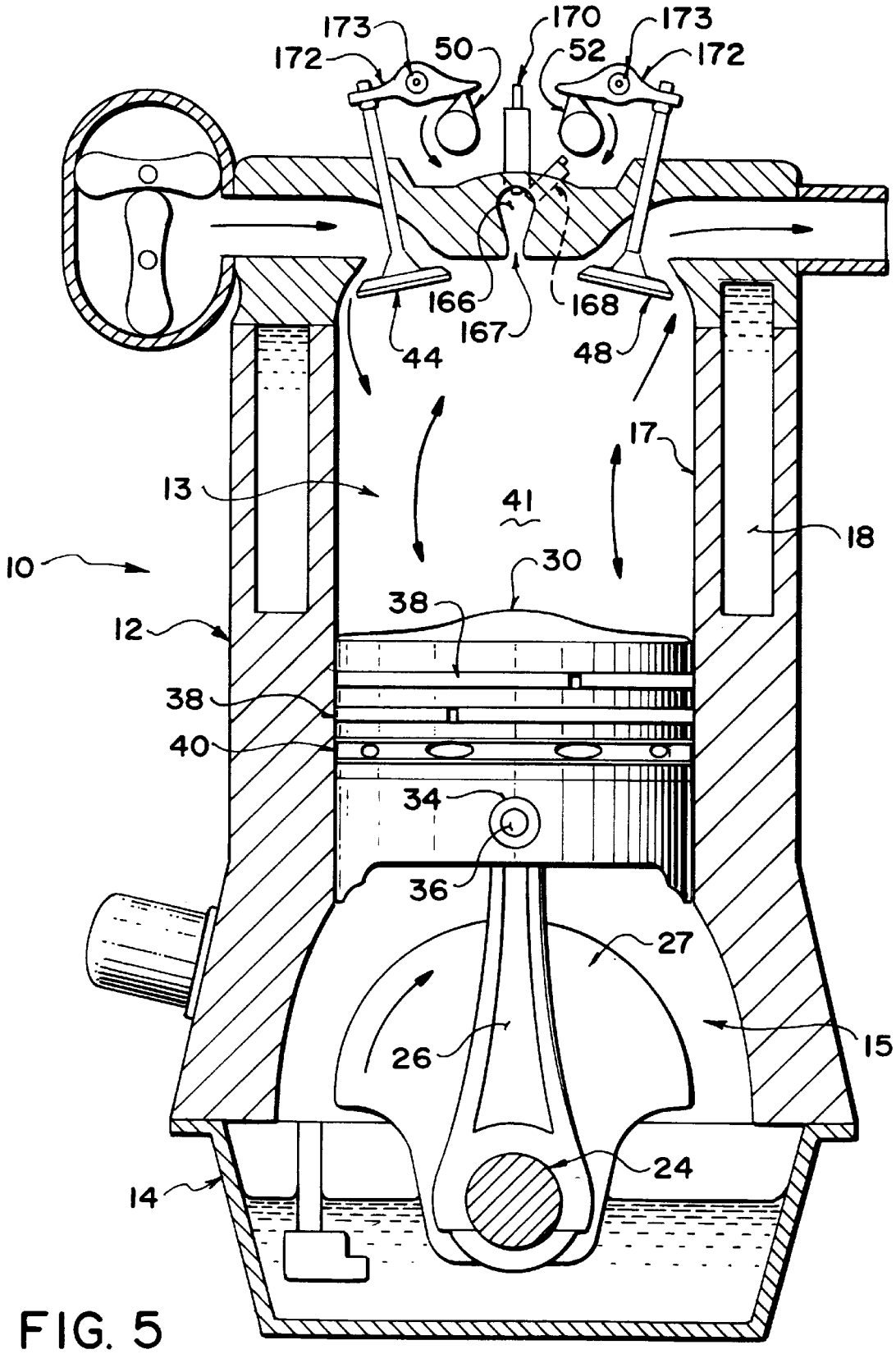
FIG. 5 is a cross sectional view of a piston cylinder arrangement within a compression ignition variant of the engine.

In FIG. 5 a compression ignition variant of the engine 10 is shown.

The engine 10 is similarly arranged to the spark ignition variant, with the exception of the valves and ignition system and the lack of a turbocharger. The engine 10 of FIG. 5 includes a pre-combustion chamber 166 mounted in the cylinder head 16 in communication with the combustion chamber 41 through a torch passage 167. A glow plug 168 and a fuel injector 170 are installed in the pre-combustion chamber 166 by conventional means.

The valves 44 and 48 are opened and closed by respective valve cams 50 and 52 with the use of rocker arms 172 mounted on rocker shafts 173. The cams 50 and 52 deflect the respective rocker arms 172 about the respective rocker shafts 173 for effectively deflecting the valves and opening and closing the valves as prescribed by the cams. The cam profiles are similar to those of the first embodiment.

Figure 7:
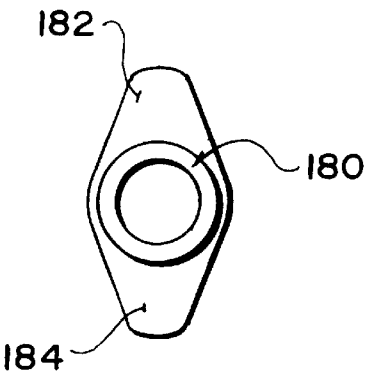
FIGS. 6 and 7 are respective side elevational and end views of an injection pump camshaft for rotation at crankshaft speed in the compression ignition variant of the engine.
Figure 6:
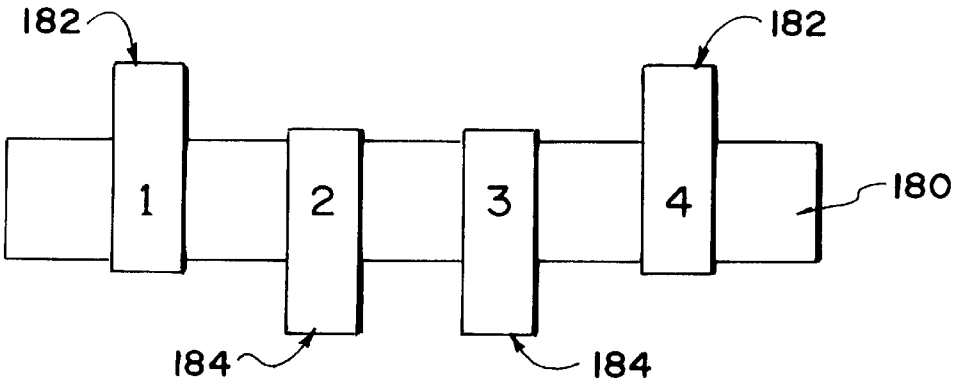

In FIGS. 6 and 7, a camshaft 180 is illustrated which operates an inline fuel injector pump for use with the engine of FIG. 5. The fuel injector pump is a conventional type having a multi-pumping element for use in four cylinder diesel engines. The camshaft is geared to the crankshaft to rotate therewith at the same speed.

The camshaft 180 includes a pair of first cams 182 which are arranged to engage fuel injectors in the respective first and fourth cylinders. The first cams 182 extend from the shaft in identical radial directions for simultaneously injecting fuel into the first and fourth cylinders with each full rotation of the crankshaft.

The camshaft also includes a pair of second cams 184 which are arranged to engage fuel injectors in the respective second and third cylinders. The second cams 184 extend from the shaft in identical radial directions for simultaneously injecting fuel into the second and third cylinders with each full rotation of the crankshaft. The second cams are 180 degrees out of phase from the first cams such that the one pair of cylinders are injected with fuel with each half rotation of the crankshaft.

Figure 9:
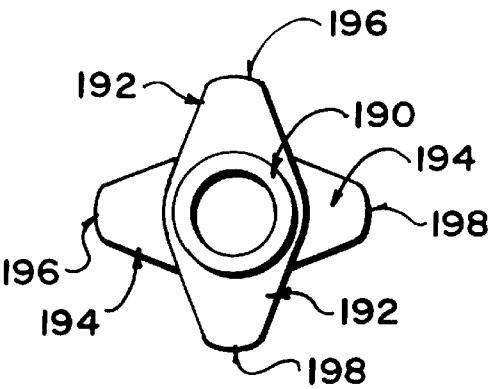
FIGS. 8 and 9 are respective side elevational and end views of an injection pump camshaft for rotation at half crankshaft speed in the compression ignition variant of the engine.
Figure 8:
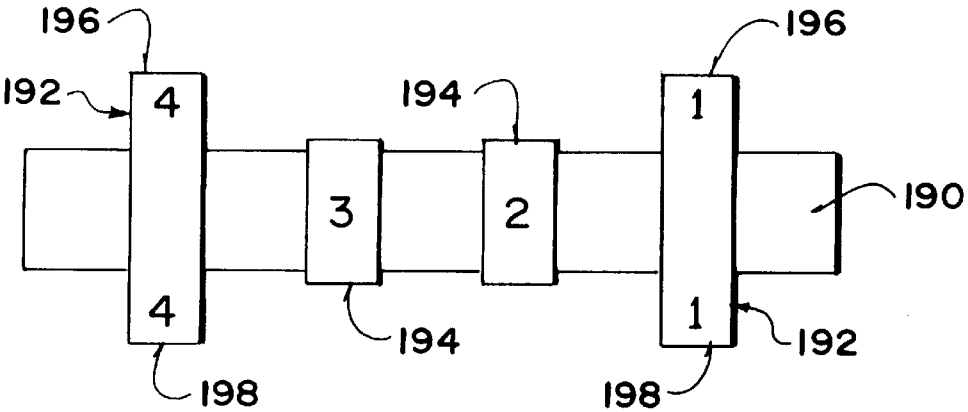

In an alternate arrangement shown in FIGS. 8 and 9, a camshaft 190 is provided which operates an inline fuel injector pump for use with the engine of FIG. 5 similarly to the camshaft 180. The camshaft 190 is geared to the crankshaft to rotate at half the crankshaft speed. This is similar to the gearing of a four stroke engine, such that the camshaft 190 is useful for converting a four stroke engine into a two stroke engine with minimal replacement of parts as replacement of the existing camshaft for the camshaft 190 does not require replacement of any gearing between the camshaft and the crankshaft.

The camshaft 190 includes a pair of first cams 192 which are arranged to engage fuel injectors in the respective first and fourth cylinders The first cams 192 extend from the shaft in identical radial directions for simultaneously injecting fuel into the first and fourth cylinders as the crankshaft is rotated.

The camshaft also includes a pair of second cams 194 which are arranged to engage fuel injectors in the respective second and third cylinders. The second cams 194 extend from the shaft in identical radial directions for simultaneously injecting fuel into the second and third cylinders with each full rotation of the crankshaft.

The first and second cams each includes a first lobe 196 and an identical second lobe 198 which is diametrically opposite from the first lobe such that the second lobe injects fuel 180 degrees out of phase from the first lobe.

The lobes of the second cams are 90 degrees out of phase from the corresponding lobes on the first cams such that the one pair of cylinders are injected with fuel with each quarter rotation of the camshaft corresponding to half rotation of the crankshaft. The engine thus fires one pair of the cylinders simultaneously with each half rotation of the crankshaft.

Figure 10:
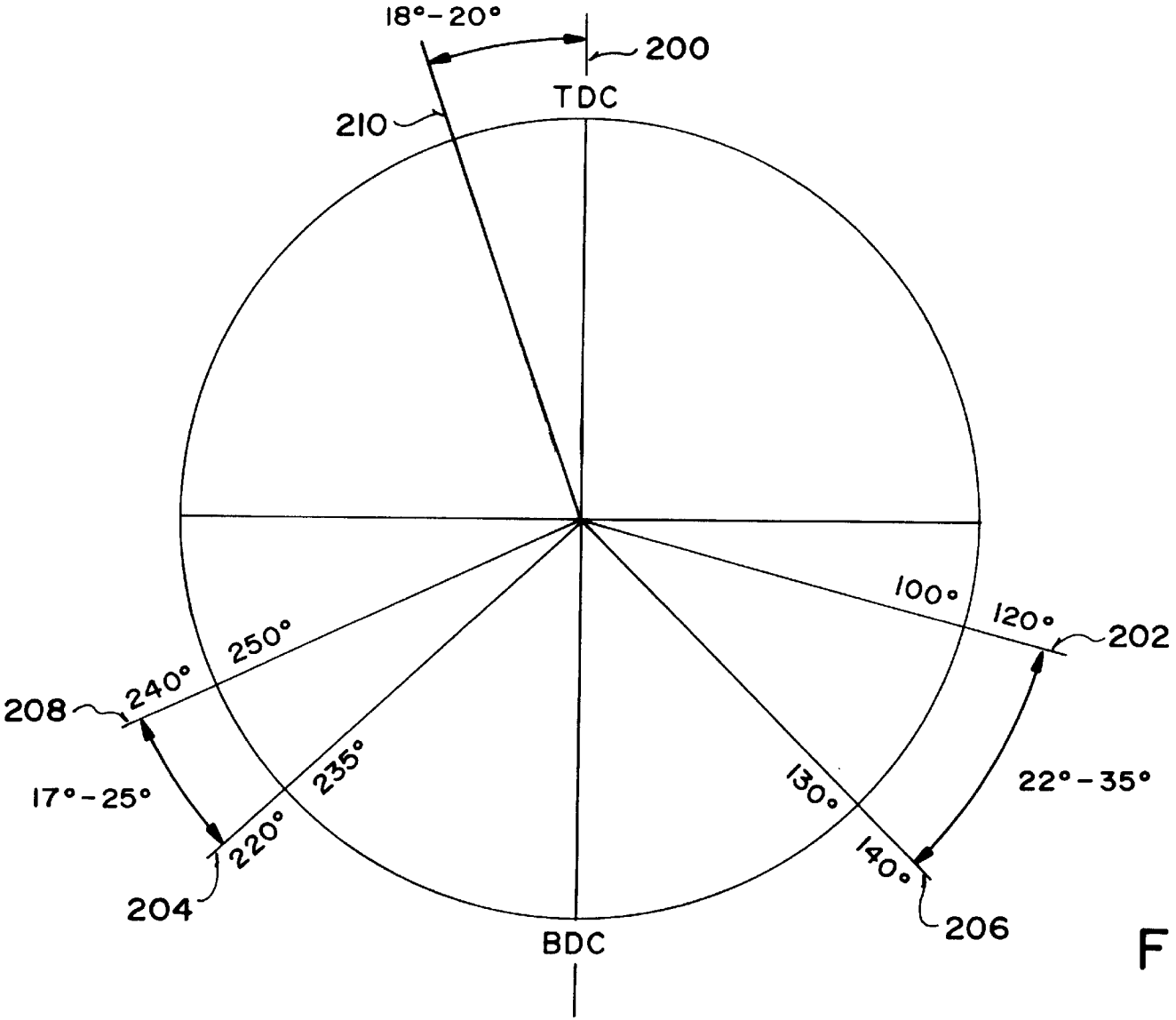
FIG. 10 is a valve timing diagram for both the compression ignition and spark ignition variants of the present invention.

In FIG. 10, the valve timing for every cylinder in both the spark ignition and compression ignition variants of the engine are shown schematically, as well as the timing of the fuel injection for the compression ignition variant. The power stroke of the engine extends from top dead centre indicated by reference numeral 200 to between 100 and 120 degrees after top dead centre indicated by reference numeral 202.

The exhaust of spent combustion gases begins between 105 and 120 degrees after top dead centre when the exhaust valve opens indicated by reference numeral 202. It ends between 225 and 235 degrees after top dead centre of crankshaft travel when the exhaust valve is dosed, indicated by reference numeral 204.

The scavenging of burnt combustion gases with a fresh charge of air begins between 130 and 140 degrees after top dead centre with the opening of the inlet and scavenge valves, indicated by reference numeral 206. It ends between 240 and 250 degrees after top dead centre of crankshaft travel when the intake and scavenge valve is closed, indicated by reference numeral 208.

Compression of the fresh air charge commences with closing of the intake and scavenge valve at reference numeral 208 and ends at top dead centre.

The duration of the exhaust valve opening is between 100 and 120 degrees of crankshaft rotation. Likewise, the duration of the opening of the intake and scavenge valve is between 100 and 120 degrees of crankshaft rotation.

The interval between the opening of the exhaust valve and the intake and scavenge valve is between 22 and 35 degrees of the crankshaft rotation as indicated as the difference between reference numerals 202 and 206. The interval between the closing of the exhaust valve and the intake and scavenger valve is between 17 and 25 degrees of crankshaft rotation which is illustrated as the difference between reference numerals 204 and 208.

In the compression ignition variant of the engine, the injection of atomised fuel is approximately between 18 and 20 degrees before top dead centre as indicated by reference numeral 210.

The conversion of four stroke operation to two stroke operation can be accomplished on any size and configuration of engine having any number of cylinders including 1, 2, 3, 4, 6, 8 or more. The resulting two stroke engine will be substantially similar to the original four stroke engine with the exception of engines having an even number of cylinders wherein the cylinders are fired in simultaneous pairs resulting from a minimal replacement of parts. The replacement of the valve cams from single lobe to dual lobe and the adjustment of the fuel injector timing by either doubling the lobes of the injector cams or by electronically adjusting the timing will effectively convert a four stroke engine into two stroke operation for improved power characteristics.

The engines described in the foregoing have been equipped with short skirt pistons with a wrist pin that is press fit into the wrist pin end of the connecting rod. No retainer ring is required at the piston bosses with this arrangement. Short skirt pistons of this type are primarily used in short stroke engines, however with long stroke engines having larger displacement, long skirt pistons having full floating wrist pins with retainers at the bosses are primarily used.

The turbocharger and the supercharger combination which can be connected in parallel or in series can be utilised in larger displacement engines. The engines could also be operated effectively using the supercharger alone.

A multi-cylinder engine could also be produced using the principles of the above described invention having side mounted valves in a flat head design with the camshaft mounted in the block. Also, the addition of valves beyond the two described above to increase the breathing capacity of the engine could be employed while the engine could still be converted from four stroke operation to two stroke operation in a similar manner.

Using the valve timing and the components described above, a conventional four stroke internal combustion engine can be converted to two stroke operation with a minimal replacement of parts. In order to convert the engine to two stroke operation, the camshaft and gearing assembly is replaced by a camshaft assembly which is arranged to open the inlet and exhaust valves once per revolution of the crankshaft. This can be accomplished by doubling the lobes or by doubling the speed of rotation of the camshaft by either of the methods noted above.

If the crankshaft is left unchanged in a four cylinder engine, the pistons will be arranged such that two pistons fire synchronously with each half revolution of the crankshaft. Either a supercharger, a turbocharger or both may then be mounted on the engine in communication with the inlet ports for supplying combustion air to the cylinders in place of the expansion stroke in a four stroke engine. A positive pressure oil lubrication pump may then be mounted within the sump of the engine as the sump is not required for pumping air through the inlet valves.

In the case of an engine having electronic fuel injection, the fuel injectors are reprogrammed to inject fuel into the respective cylinders once per revolution of the crankshaft as opposed to every second revolution as in four stroke operation. In the case of cam actuated fuel injectors, the fuel injector camshaft can be replaced by a camshaft having dual lobed cams geared to turn at half crankshaft speed or a camshaft having single lobed cams geared to turn at crankshaft speed for injecting fuel into the respective cylinders once per revolution of the crankshaft.

In either embodiment, a conventional four stroke, four cylinder engine is converted to a two stroke engine wherein two pistons are fired synchronously every half revolution of the crankshaft with a minimal replacement of parts. The resulting engine exhibits improved torque characteristics without expensive or time consuming engine refitting.

While some embodiments of the present invention have been described in the foregoing, it is to be understood that other embodiments are possible within the scope of the invention. The invention is to be considered limited solely by the scope of the appended claims.

What is claimed is:

1. A method of converting to two stroke operation a four stroke internal combustion engine having a plurality of pistons arranged for reciprocating movement within respective cylinders, an inlet valve and an exhaust valve associated with each cylinder, a crankshaft coupled to the pistons, the crankshaft being driven to rotate by reciprocation of the pistons, an original camshaft assembly coupled to the crankshaft, the camshaft assembly comprising at least one original camshaft carrying a plurality of original cams for actuating respective inlet and exhaust valves, an original drive assembly coupling the camshaft to the crankshaft such that the camshaft is rotated at half a speed of the crankshaft, and electronic fuel injection for injecting fuel into the respective cylinders; said method comprising:

providing a replacement camshaft assembly for actuating the respective inlet and exhaust valves, the replacement camshaft assembly being arranged to open each of the valves once per revolution of the crankshaft;

replacing the original camshaft assembly with the replacement camshaft assembly: and programming the electronic fuel injection to inject fuel in each cylinder once per revolution of the crankshaft.

2. The method according to claim 1 wherein the replacement camshaft assembly comprises at least one replacement camshaft carrying a plurality of replacement cams, each replacement cam having a pair of lobes such that a corresponding one of the valves is opened twice per revolution of the said at least one replacement camshaft.

3. The method according to claim 2 wherein the pair of lobes of each replacement carn are 180 degrees out of phase from each other such that the respective valve is opened twice per revolution of said at least one replacement camshaft.

4. The method according to claim 2 wherein there is provided a replacement drive assembly comprising a driven sprocket on said at least one replacement camshaft driven by a driving sprocket on the crankshaft, the driven sprocket having twice a number of teeth of the driving sprocket such that said at least one replacement camshaft is rotated at half crankshaft speed.

5. The method according to claim 1 wherein the replacement camshaft assembly comprises a replacement drive assembly having a driven sprocket on at least one replacement camshaft driven by a driving sprocket on the crankshaft, the driven sprocket having a number of teeth equal to a number of teeth on the driving sprocket such that said at least one replacement camshaft is rotated at crankshaft speed.

6. The method according to claim 5 wherein said at least one replacement camshaft carries a plurality of replacement cams, each replacement cam having a single lobe such that a corresponding one of the valves is opened once per revolution of said at least one replacement camshaft.

7. The method according to claim 1 wherein the method induces mounting a turbocharger on the engine in communication with the inlet valves for supplying combustion air above atmospheric pressure to the cylinders.

8. The method according to claim 1 wherein the method includes mounting a supercharger on the engine in communication with the inlet valves for supplying combustion air above atmospheric pressure to the cylinders.

9. The method according to claim 8 wherein the method induces mounting a turbocharger on the engine in communication with the inlet valve in addition to the supercharger for supplying combustion air above atmospheric pressure to the cylinders.

10. The method according to claim 1 wherein the engine includes a plurality of pairs of pistons, said method comprising firing each pair of pistons synchronously once per revolution of the crankshaft.

11. The method according to claim 1 wherein the method includes providing a pressure feed lubrication system within a sump of the engine for lubricating the pistons.

12. A two stroke internal combustion engine comprising:

a plurality of pairs of pistons arranged for sliding movement within respective cylinders, a first and second piston of each pair of pistons being located in a same position relative to the respective cylinders as the first and second pistons are displaced together within the respective cylinders such that the first and second pistons are fired synchronously;

an inlet valve and an exhaust valve associated with each cylinder;

a crankshaft coupled to the pistons, the crankshaft being driven to rotate by the synchronous firing of the first and second pistons of each of the pairs of pistons;

a camshaft assembly coupled to the crankshaft, the camshaft assembly comprising:

at least one camshaft:

a plurality of inlet and exhaust cams mounted on said at least one camshaft for engaging the respective inlet and exhaust valves; and a drive assembly coupling said at least one camshaft to the crankshaft such that the inlet and exhaust cams open the respective valves once per revolution of the crankshaft;

the inlet and exhaust cams being arranged such that the exhaust valve of each cylinder opens before the respective inlet valve opens and closes before the respective inlet valve closes;

the inlet valve and the exhaust valve of each cylinder both being open together for a portion of each piston stroke in an overlapping configuration; and the inlet valve and the exhaust valve of the first and second pistons of each pair of pistons being arranged to be opened and closed synchronously by the inlet and exhaust cams;

and air supply mechanism mounted in communication with the inlet valves arranged to supply combustion air above atmospheric pressure to the cylinders.

13. The engine according to claim 12 wherein each cam includes a pair of lobes spaced 180 degrees apart about the respective camshaft and the drive assembly couples the camshaft to the crankshaft to rotate the camshaft at half crankshaft speed such that each of the valves is opened twice per revolution of the camshaft.

14. The engine according to claim 12 wherein the engine includes two pairs of pistons, the first and second pistons of each pair of pistons being arranged to be fired synchronously once per revolution of the crankshaft.

15. The engine according to claim 14 wherein the two pairs of pistons are arranged to be fired 180 degrees apart in a four cylinder engine.

16. The engine according to claim 12 wherein the air supply mechanism comprises a turbocharger mounted in communication with the inlet valves for supplying combustion air above atmospheric pressure to the cylinders.

17. A two stroke internal combustion engine comprising:

a plurality of pairs of pistons arranged for sliding movement within respective cylinders, a first and second piston of each pair of pistons being located in a same position relative to the respective cylinders as the first and second pistons are displaced within the respective cylinders such that the first and second pistons are fired synchronously;

an inlet valve and an exhaust valve associated with each cylinder;

a crankshaft coupled to the pistons, the crankshaft being driven to rotate by reciprocation of the pistons:

a camshaft assembly coupled to the crankshaft, the camshaft assembly comprising:

a plurality of cams mounted on a camshaft for engaging the respective inlet and exhaust valves; and a drive assembly coupling the camshaft to the crankshaft such that the cams open the respective valves once per revolution of the crankshaft;

a cam actuated fuel injector for injecting fuel into the respective cylinders;

and dual lobed injector cams driven at half crankshaft speed for injecting fuel into the respective cylinders once per revolution of the crankshaft.

18. A method of converting to two stroke operation a four stroke internal combustion engine having a plurality of pistons arranged for reciprocating movement within respective cylinders, an inlet valve and an exhaust valve associated with each cylinder, a crankshaft coupled to the pistons, the crankshaft being driven to rotate by reciprocation of the pistons, an original camshaft assembly coupled to the crankshaft, the valve camshaft assembly comprising at least one original valve camshaft carrying a plurality of original valve cams for actuating respective inlet and exhaust valves, an original valve drive assembly coupling the valve camshaft to the crankshaft such that the valve camshaft is rotated at half a speed of the crankshaft, cam actuated fuel injectors, and an original injector drive assembly including at least one original injector camshaft carrying a plurality of original injector cams for actuating the fuel injectors, the original injector drive assembly coupling the injector camshaft to the crankshaft for injecting fuel into each cylinder once for every two rotations of the crankshaft; said method comprising:

providing a replacement valve camshaft assembly for actuating the respective inlet and exhaust valves, the replacement valve camshaft assembly being arranged to open each of the valves once per revolution of the crankshaft;

replacing the original valve camshaft assembly with the replacement valve camshaft assembly;

providing a replacement injector camshaft assembly for actuating the fuel injectors, the replacement injector camshaft assembly being arranged to inject fuel into each cylinder once for every rotation of the crankshaft; and replacing the original injector camshaft assembly with the replacement injector camshaft assembly.

19. The method according to claim 18 wherein the method includes providing dual lobed fuel injector cams driven at half crankshaft speed for injecting fuel into the respective cylinders once per revolution of the crankshaft.

20. The method according to claim 18 wherein the method includes providing single lobed fuel injector cams driven at crankshaft speed for injecting fuel into the respective cylinders once per revolution of the crankshaft.

* * * * *